US011105056B1

(12) United States Patent
Christopherson

(10) Patent No.: US 11,105,056 B1
(45) Date of Patent: Aug. 31, 2021

(54) STANCHION WITH ENHANCED STABILITY AND SAFETY

(71) Applicant: Daniel John Christopherson, Aguanga, CA (US)

(72) Inventor: Daniel John Christopherson, Aguanga, CA (US)

( * ) Notice: Subject to any disclaimer, the term of this patent is extended or adjusted under 35 U.S.C. 154(b) by 229 days.

(21) Appl. No.: 16/559,937

(22) Filed: Sep. 4, 2019

Related U.S. Application Data

(60) Provisional application No. 62/804,964, filed on Feb. 13, 2019.

(51) Int. Cl.
*E01F 13/02* (2006.01)
*E04H 12/20* (2006.01)
*E04H 17/20* (2006.01)

(52) U.S. Cl.
CPC ..... *E01F 13/028* (2013.01); *E04H 12/20* (2013.01); *E04H 17/20* (2013.01)

(58) Field of Classification Search
CPC ..... E04H 12/2238; E04H 12/2246; E04H 12/2253; E04H 12/2269; E04H 17/20; E04H 17/21; E04H 17/22; E01F 13/02; E01F 13/022; E01F 13/028
See application file for complete search history.

(56) References Cited

U.S. PATENT DOCUMENTS 2,291,975 A * 8/1942 Minero ..... A47B 13/06 248/418
3,554,075 A * 1/1971 Johnson ..... F16B 21/04 411/349
3,963,361 A * 6/1976 Schenk ..... F16D 1/108 403/255
5,607,251 A * 3/1997 Rafn ..... E02F 3/3609 37/406
5,836,714 A * 11/1998 Christensen ..... E01F 9/70 404/6
6,338,649 B1 * 1/2002 Smith ..... H01R 11/282 411/552
7,147,399 B2 * 12/2006 Viscount ..... A63C 19/062 403/349
9,717,974 B2 * 8/2017 Hahn ..... E04H 12/2238
10,609,994 B2 * 4/2020 Vanderminden ..... F16M 13/00
2007/0241314 A1 * 10/2007 Tsai ..... E01F 13/028 256/24
2018/0186305 A1 * 7/2018 Kanie ..... F16B 5/065

* cited by examiner

*Primary Examiner* — Jonathan P Masinick
(74) *Attorney, Agent, or Firm* — Plager Schack LLP; Mark H. Plager; Eric LNiou

(57) ABSTRACT

A stanchion with enhanced stability and user safety is provided. The stanchion includes a base having a top surface, a bottom surface and a central opening extending from the top surface to the bottom surface, the central opening in the base having an inner surface with a locking protrusion coupled thereto, and an elongated body with a bottom end rotatably mounted to the central opening of the base and having a pair of tabs. The elongated body is designed to rotate to a first position to permit one of the pair of tabs to engage with the locking protrusion on the base, thereby locking the elongated body to the base. The elongated body is designed to rotate to a second position with the pair of tabs disengaged from the locking protrusion on the base, thereby unlocking the elongated body from the base.

10 Claims, 4 Drawing Sheets

STANCHION WITH ENHANCED STABILITY AND SAFETY

RELATED APPLICATION

The application claims priority to provisional patent application U.S. Ser. No. 62/804,964 filed on Feb. 13, 2019, the entire contents of which is herein incorporated by reference.

BACKGROUND

The embodiments herein relate generally to stanchions. More specifically, embodiments of the invention are directed to a stanchion with enhanced stability and safety.

Stanchions are upright bars or posts that are disposed on the ground and often connected together by belts, ropes, chains and the like. Stanchions are commonly used in public places, both outdoors and indoors, to organize and/or control the flow of people waiting in lines or moving around.

Current stanchions are heavy one-piece constructions that are difficult to maneuver, store and transport. Further, these stanchions pose safety risks when they are pushed or knocked over. Due to their heavy weight, these stanchions can cause serious bodily injury and/or death when they fall on children or adults. Further, these stanchions can topple over and destroy property such as windows, glass doors, other structures, and the like. Current stanchions have further limitations in that they can rust and tarnish easily, thereby requiring frequent maintenance to clean and/or polish the members.

As such, there is a need in the industry for a stanchion with enhanced stability and user safety that addresses the limitations of the prior art, which has an anti-tilt mechanism that helps to maintain the stanchion in an upright position when disposed on the ground. There is a need for the stanchion to be light weight with its components detachable to allow for easy storage and transportation of the stanchion.

SUMMARY

In certain embodiments, a stanchion with an anti-tilt mechanism to enhance stability and user safety is provided. The stanchion comprises a base comprising a top surface, a bottom surface opposite the top surface, and a central opening disposed therethrough and extending from the top surface to the bottom surface, the central opening in the base comprising an inner surface with a locking protrusion coupled thereto, and an elongated body coupled to the base and comprising a top end and a bottom end, the bottom end of the elongated body rotatably mounted to the central opening of the base and comprising a pair of tabs, wherein the elongated body is configured to rotate to a first position to permit one of the pair of tabs to engage with the locking protrusion on the inner surface of the base, thereby locking the elongated body to the base, wherein the elongated body is configured to rotate to a second position with the pair of tabs disengaged from the locking protrusion on the inner surface of the base, thereby unlocking the elongated body from the base.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
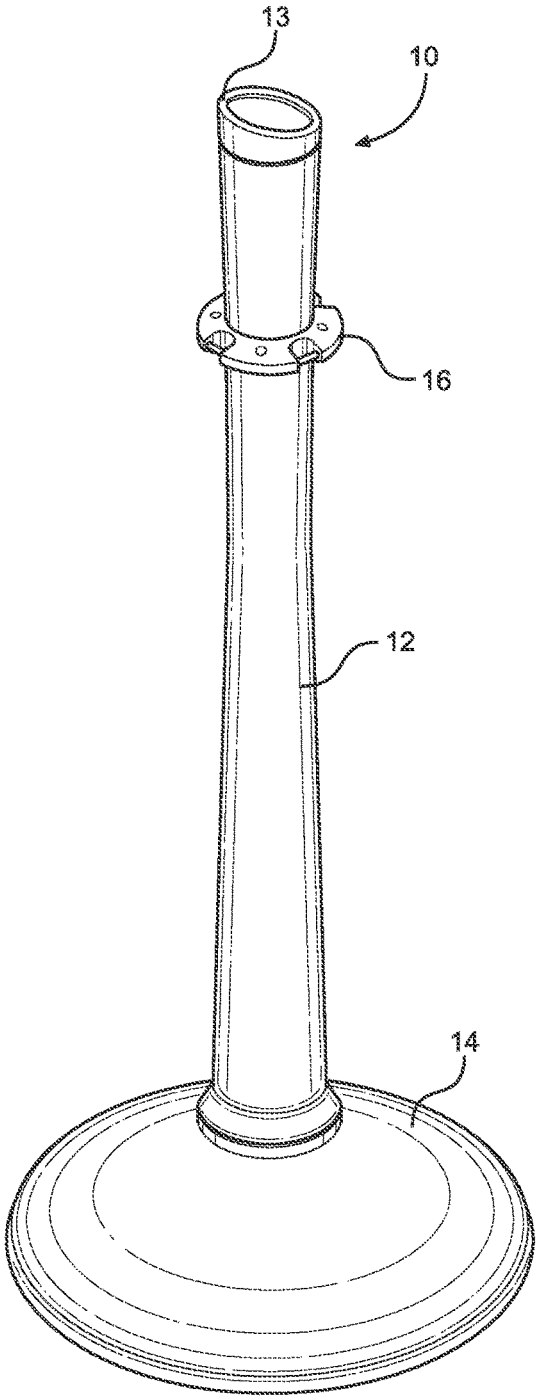
FIG. 1 depicts a perspective view of certain embodiments of the stanchion with a hook fastener.
Figure 2:
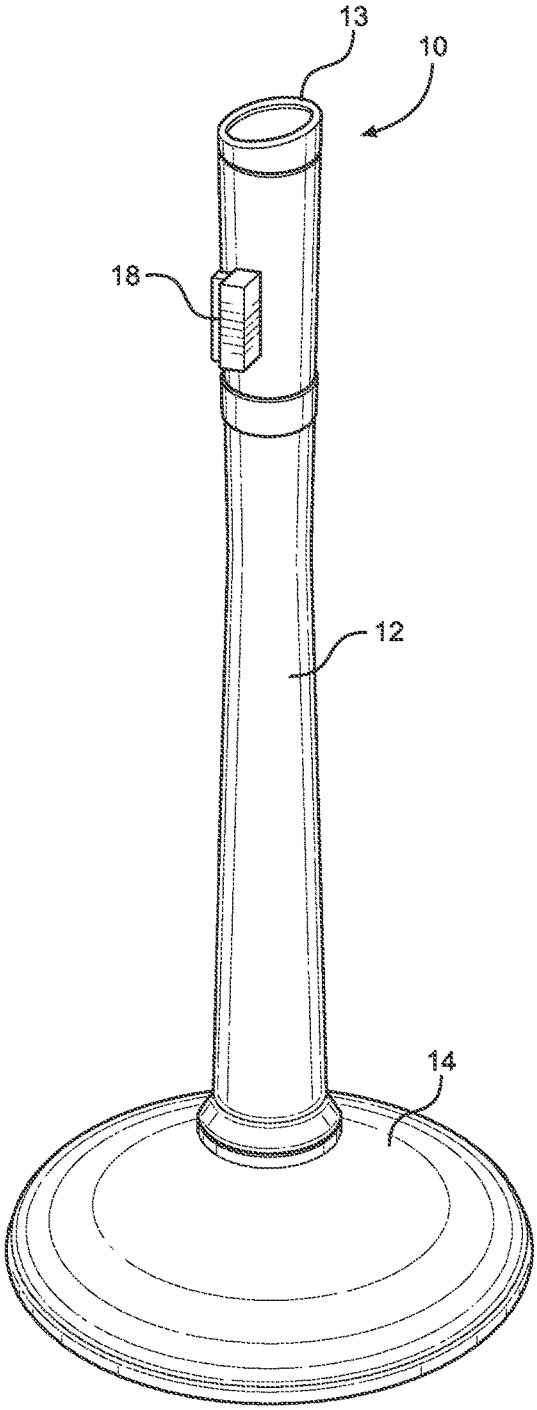
FIG. 2 depicts a perspective view of certain embodiments of the stanchion with a retractable belt housing.
Figure 6:
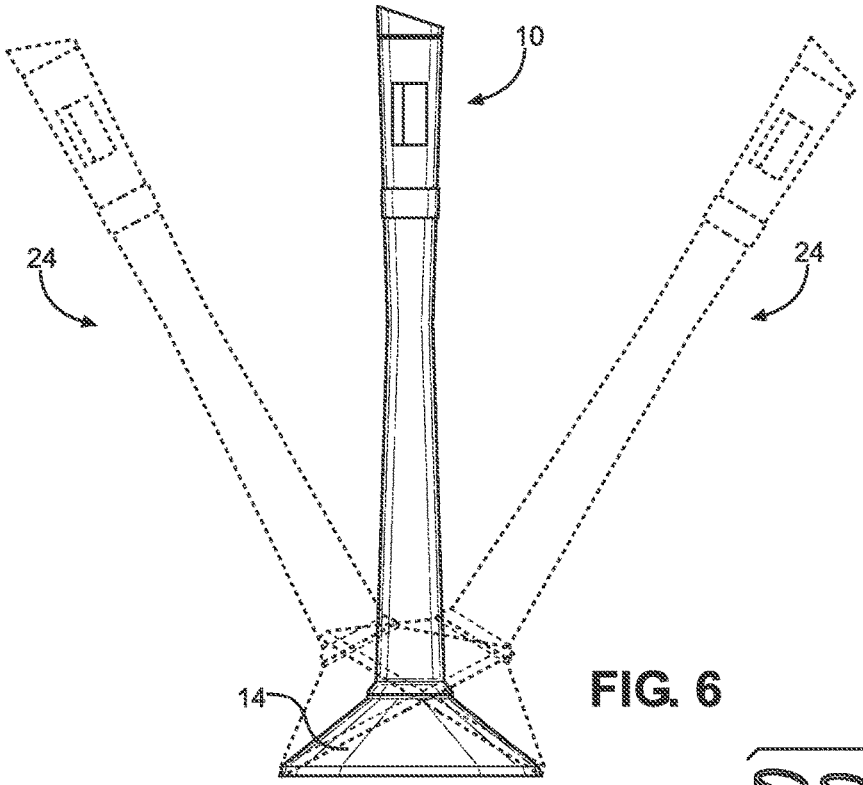
FIG. 6 depicts a side view of certain embodiments of the stanchion illustrating the anti-tilt capability that maintains the stanchion in an upright position.

In certain embodiments as depicted in FIGS. 1-2 and 6, stanchion 10 is a light weight stanchion that easily assembles and disassembles as needed to improve storage, portability and transportation. Stanchion 10 enhances safety by providing a weighted base that helps the stanchion to maintain an upright position on the ground. This prevents stanchion 10 from knocking over and injuring people or damaging property.

In certain embodiments, stanchion 10 generally comprises body 12 and base 14. In a preferred embodiment, body 12 and base 14 are made from high density polyethylene. However, alternative materials known in the field can be used to make the components of stanchion 10.

Figure 5:
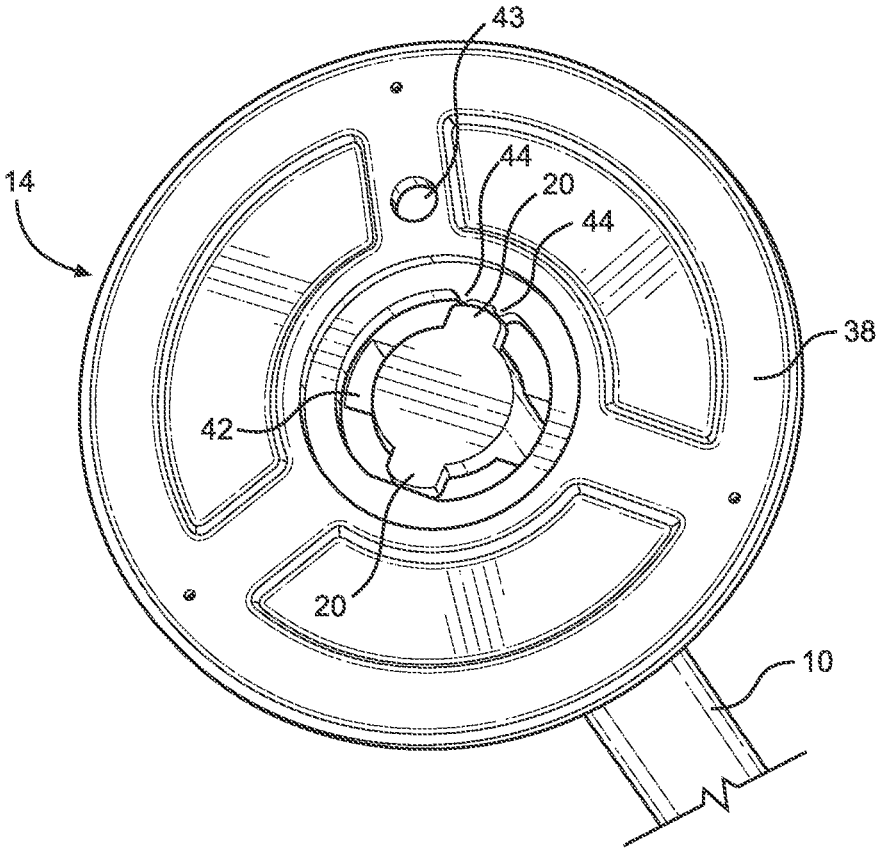
FIG. 5 depicts a bottom perspective view of certain embodiments of the stanchion illustrating body 12 and base 14 in a locked position.
Figure 8:
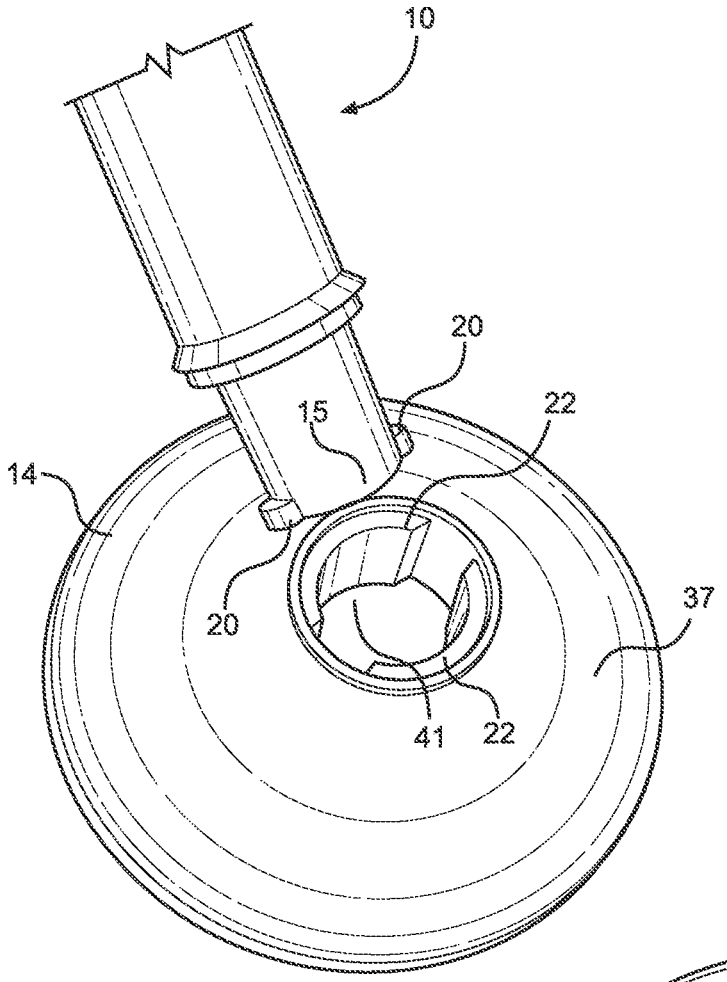
FIG. 8 depicts an exploded view of certain embodiments of the stanchion.
Figure 9:
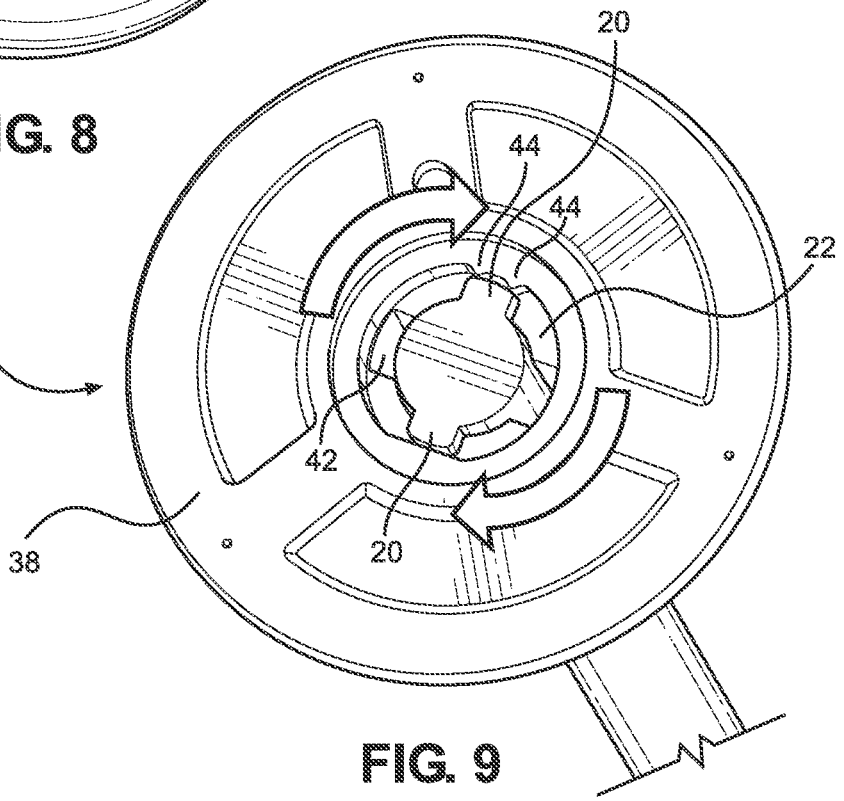
FIG. 9 depicts a bottom perspective view of certain embodiments of the stanchion illustrating the rotation of body 12 relative to base 14.

In certain embodiments as depicted in FIGS. 1-2 and 8, body 12 is an elongated tubular member with a hollow interior and comprising top end 13 and bottom end 15. In one embodiment, body 12 flares slightly from an intermediate portion of the tubular member to top end 13 and also the intermediate portion of the tubular member to bottom end 15. In one embodiment as depicted in FIGS. 5 and 8-9, the bottom end of body 12 comprises a pair of tabs 20. Tabs 20 are oppositely oriented on the perimeter of the bottom end of body 12. In one embodiment, tabs 20 are continuously connected to body 12. However, tabs 20 can be separate components that are coupled to body 12 by an adhesive or other fasteners in an alternative embodiment.

Figure 3:
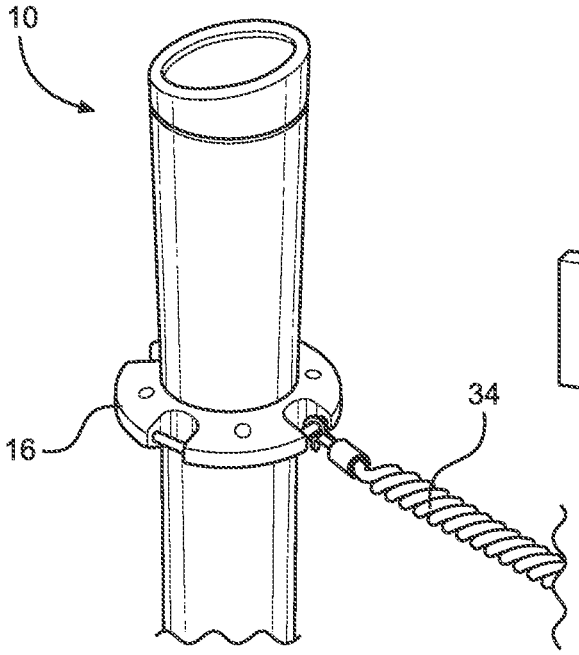
FIG. 3 depicts a perspective view of certain embodiments of the stanchion illustrating a hook fastener connected to a rope.
Figure 4:
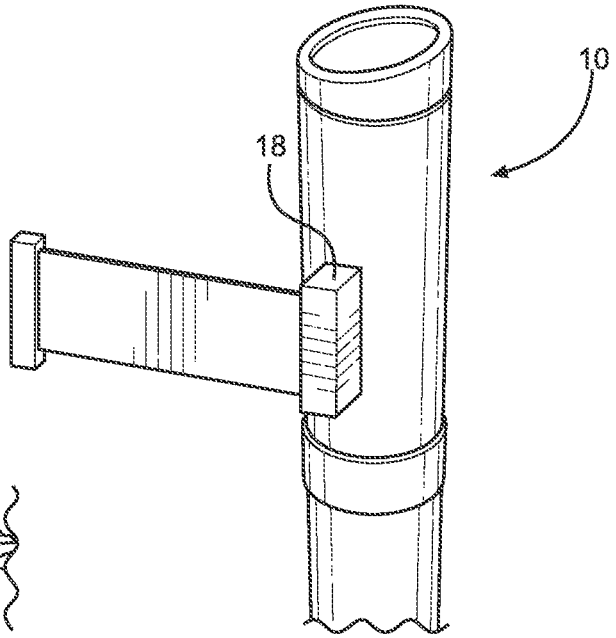
FIG. 4 depicts a perspective view of certain embodiments of the stanchion illustrating the retractable belt housing in use.

Bodies 12 of stanchions 10 can be connected together by different fastening components. In one embodiment as depicted in FIGS. 1 and 3, hook fastener 16 is coupled to body 12 of each stanchion 10 and comprises a plurality of loop locations that permit the attachment of a hook thereto. This allows an end of rope 34 to be coupled to one of these loop locations on hook fastener 16 by a hook. In one embodiment as depicted in FIGS. 2 and 4, retractable belt housing 18 is coupled to body 12 of stanchion 10. Retractable belt housing 18 stores a retractable belt cassette, which allows a belt to extend or retract as needed. The end of the belt can be connected to a receiving member on body 12 of another stanchion 10. It shall be appreciated that alternative components can be used to connect stanchions 10 together in alternative embodiments.

In certain embodiments as depicted in FIGS. 5 and 8-9, bottom end 15 of body 12 is detachably coupled to base 14 to form the assembled stanchion 10. Base 14 comprises top surface 37, bottom surface 38 and central opening 41. Central opening 41 extends entirely through base 14 from top surface 37 to bottom surface 38.

Base 14 comprises an inner cavity that stores ballast. In one embodiment, the ballast may comprise any type of material or combination of materials including, but not limited to, sand, gravel, ground stones, metal or other materials. In one embodiment as depicted in FIG. 5, the inner cavity of base 14 is accessible through sealable opening 43 on bottom surface 38. In one embodiment, a plug (not shown) is inserted in sealable opening 43 to seal the inner cavity of base 14. The plug is removed from sealable opening 43 to provide access to the inner cavity of base 14. This allows a user to add or remove ballast from the inner cavity of base 14.

In a preferred embodiment, approximately 11-12 lb of ballast are disposed within the inner cavity of base 14 during use of stanchion 10. However, it shall be appreciated that alternative amounts of ballast can be used with base 14 in alternative embodiments.

In one embodiment as depicted in FIGS. 8-9, a pair of walls 22 is coupled to the inner surface of central opening 41 in base 14. Walls 22 are oppositely oriented from each other and extend along the inner surface of central opening 41 to form elongated slot 42 within central opening 41 as depicted in FIG. 9. In one embodiment as depicted in FIGS. 5 and 9, a pair of locking protrusions 44 is coupled to the inner surface of central opening 41 proximate bottom surface 38 of base 14. Locking protrusions 44 comprise any type of knobs, nubs, lugs and the like. It shall be appreciated that a single locking protrusion 44 or any alternative number of locking protrusions 44 can be coupled to central opening 41 of base 14 in alternative embodiments.

In operation, stanchion 10 is assembled by inserting bottom end 15 of body 12 through central opening 41 of base 14 as depicted in FIG. 8. During this insertion, the pair of tabs 20 on bottom end 15 of body 12 should be aligned with elongated slot 42 within central opening 41 of base 14. This allows tabs 20 of body 12 to lower to the proper position for rotatable adjustments. In one embodiment as depicted in FIG. 9, body 12 is rotatably adjusted relative to base 14 to the locked or unlocked positions.

Specifically, body 12 is rotated to a first position to permit one of tabs 20 of body 12 to engage with locking protrusions 44 on base 14 as depicted in FIG. 5. This is the locked position that firmly secures body 12 and base 14 together. Body 12 is rotated to a second position to permit the pair of tabs 20 of body 12 to disengage from locking protrusions 44 on base 14 and align with elongated slot 42 of base 14. This allows body 12 to be pulled upward to detach from base 14.

In the assembled and locked position as depicted in FIG. 6, the weight of base 14 due to the housing and stored ballast combined with the hollow and light weight construction of body 12 allows stanchion 10 to maintain an upright position. The weight of base 14 is sufficient so that any tilt 24 of body 12 up to +/−45 degrees will cause stanchion 10 to move back to the resting position with base 14 firmly planted against the ground. This occurs because the weight of base 14 is greater than the weight of body 12. This greatly enhances the safety of stanchion 10 and prevents it from knocking over on people or property.

Figure 7:
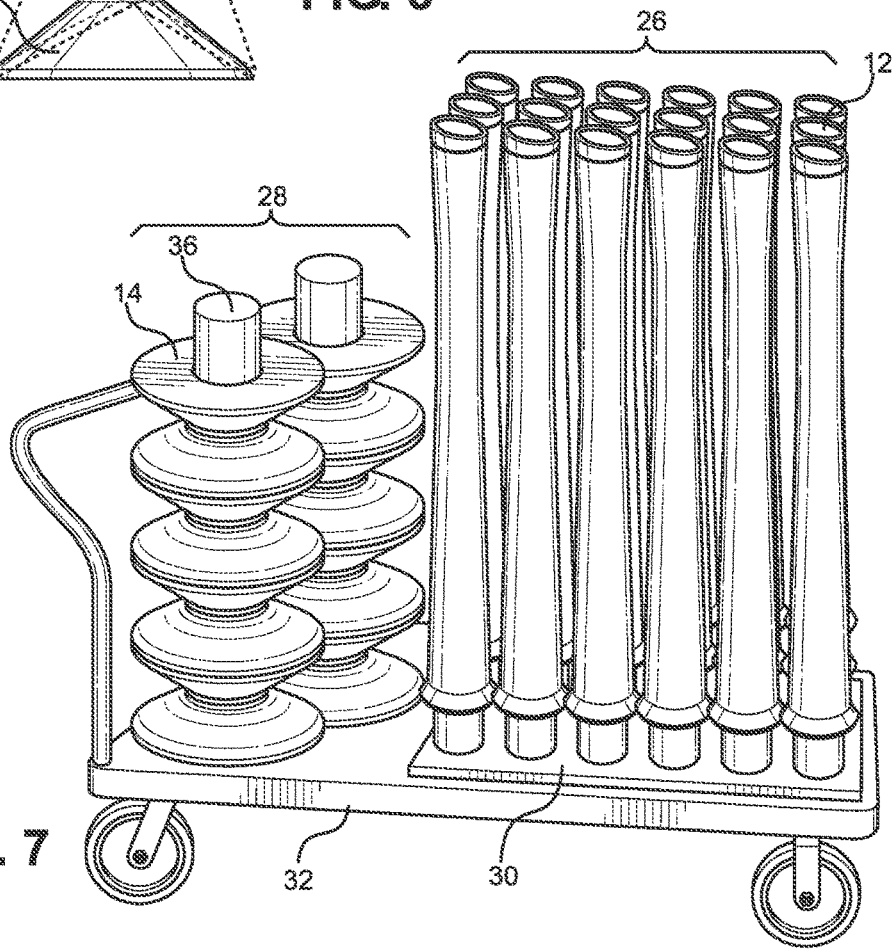
FIG. 7 depicts a perspective view of certain embodiments illustrating a cart for stacking multiple bases and bodies of a plurality of stanchions.

In one embodiment as depicted in FIG. 7, stanchions 10 can be easily disassembled and stored on cart 32 for easy transportation. In this embodiment, a plurality of posts 36 are coupled to cart 32 to permit the stacking of multiple bases 14 from set 28 thereon. In one embodiment, storage base 30 is disposed on cart 32 to store a plurality of bodies 12 from set 26 thereon. In one embodiment, storage base 30 comprises twist-type locking mechanisms that allow bodies 12 to be easily attached and detached from storage base 30.

It shall be appreciated that the components of the stanchion described in several embodiments herein may comprise any alternative known materials in the field and be of any color, size and/or dimensions. It shall be appreciated that the components of the stanchion described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A stanchion with an anti-tilt mechanism to enhance stability and user safety, the stanchion comprising:

a base comprising a top surface, a bottom surface opposite the top surface, and a central opening disposed therethrough and extending from the top surface to the bottom surface, the central opening in the base comprising an inner surface with a locking protrusion coupled thereto; and an elongated body coupled to the base and comprising a top end and a bottom end, the bottom end of the elongated body rotatably mounted to the central opening of the base and comprising a pair of tabs;

wherein the elongated body is configured to rotate to a first position to permit one of the pair of tabs to engage with the locking protrusion on the inner surface of the base, thereby locking the elongated body to the base, wherein the elongated body is configured to rotate to a second position with the pair of tabs disengaged from the locking protrusion on the inner surface of the base, thereby unlocking the elongated body from the base.

2. The stanchion of claim 1, wherein the base comprises an inner cavity that houses ballast.

3. The stanchion of claim 2, further comprising a pair of walls coupled to the inner surface of the central opening of the base and oppositely oriented from each other, the pair of walls forming an elongated slot within the central opening of the base.

4. The stanchion of claim 3, wherein the pair of tabs of the elongated body do not align with the elongated slot when the elongated body is in the first position, wherein the pair of tabs of the elongated body align with the elongated slot when the elongated body is in the second position, thereby permitting the elongated body to detach from the base.

5. The stanchion of claim 4, further comprising another locking protrusion coupled to the inner surface of the central opening of the base, wherein the elongated body in the first position permits one of the pair of tabs to engage with the locking protrusions on the base, wherein the elongated body in the second position permits the pair of tabs to disengage from the locking protrusions on the base.

6. The stanchion of claim 5, wherein the elongated body comprises a first weight and the base comprises a second weight, wherein the second weight is greater than the first weight.

7. The stanchion of claim 6, wherein the elongated body comprises a tubular member.

8. The stanchion of claim 7, further comprising a sealable opening in the bottom surface of the base, the sealable opening configured to open to provide access to the inner cavity of the base or close to seal the inner cavity of the base.

9. The stanchion of claim 8, further comprising a fastener coupled to the elongated body to permit attachment of a rope thereto.

10. The stanchion of claim 8, further comprising a housing coupled to the elongated body, the housing having a retractable belt coupled thereto.

* * * * *